United States Patent [19]

Magni

[11] Patent Number: 4,553,899

[45] Date of Patent: Nov. 19, 1985

[54] HIGH LIFT TRUCK WITH TELESCOPING BOOM ASSEMBLIES

[76] Inventor: Riccardo Magni, Via Segantini, 58, Modena, Italy, 41100

[21] Appl. No.: 552,461

[22] Filed: Nov. 16, 1983

[51] Int. Cl.[4] ..... E02F 3/72

[52] U.S. Cl. ..... 414/629; 414/718; 414/728

[58] Field of Search ..... 414/628, 629, 630, 631, 414/718, 728

[56] References Cited

U.S. PATENT DOCUMENTS 3,178,046 4/1965 Lull ..... 414/718

3,985,248 10/1976 Liegel et al. ..... 414/718

4,382,743 5/1983 Newell ..... 414/718 X

*Primary Examiner*—Robert G. Sheridan

*Attorney, Agent, or Firm*—Darby & Darby

[57] ABSTRACT

A high lift truck with telescopic boom improves upon and widens the scope of performance offered by existing high lifts of the type. Its essential feature, basically, is that of providing a second telescopic boom (16) fixed immovably to the top end of the first raise-and-lower boom (4) which is likewise telescopic, and hinges at bottom with a mounting (7) on the truck chassis; the two booms thus associated creating an obtuse angle such that the second boom will project forward along the line of the truck axis when boom (4) aforesaid is fully raised.

3 Claims, 3 Drawing Figures

HIGH LIFT TRUCK WITH TELESCOPING BOOM ASSEMBLIES

BACKGROUND OF THE INVENTION

The invention described herein relates to a self-propelled lift truck which utilizes a telescopic boom system, particularly intended for raising loads up to considerable height. A typical application is that of moving materials about on building sites, especially where brick-built or prefabricated and/or cast-in-situ concrete industrial buildings are being erected, but the truck finds usefulness in the widest imaginable range of industrial and agricultural sectors wherever general lifting, handling and warehousing requirements prevail.

Essential features of lift trucks to which the 'high lift' name is commonly applied are basically the following:

ability to bring a load up to considerable height off the ground—at least 30 ft up;

generous outreach, or forward reach in this instance, permitting of horizontal extension of the load to a notable distance-forward, with respect to the truck's own foremost frontal plane (generally accepted as being the vertical plane lying tangential to the foremost edge of the front wheels);

compactness in the folded-down state, or more exactly, a design envisaging fold-down within acceptable limits which enable the truck's being manoeuvered easily, as well as permitting entry into tight areas walled-in and roofed in such a way as to inhibit easy access;

simple, easy-to-operate controls working the entire vehicle-and-lifting gear;

low production cost.

Of known high lift trucks, a first type used in the past incorporates two or more booms of unvarying length articulating one with the next via horizontally-disposed hinges and caused to rotate thus by hydraulic actuators. This particular design is by now obsolete to all intents and purposes, since height and forward reach could never be of a great order due to the machine's being incapable of a compact fold-down to within acceptable limits.

A second type—more modern, and still in widespread use after a number of years—has a telescopic boom (most commonly, two-stage) hinged at the bottom end to the truck chassis and fitted at the top end with an appliance or attachment which carries the load—normally taking the shape of forks which slip in between the wooden laths of a loading-pallet. The attachment itself is hung-out at a short distance from the topmost end of the telescopic boom, remaining thus cantilivered during operation. Despite the improvement, this embodiment of the lift truck has the drawback of offering a limited forward reach at medium and maximum lift heights, and what is more, horizontal penetration is lacking when obstacles are encountered at such heights—that is, the load cannot be extended to any reasonable distance beyond the forward edge offered by said obstacle—were it to be, for instance, the point where the facing wall of a building meets with the horizontal surface onto which the load must be set down—since the telescopic boom itself would come up against such an edge when traveling forward. Likewise, if one has scaffolding erected alongside the wall of a building, the 'obstacle' is brought forward even further, making it totally impossible to set down a load on the building beyond the scaffolding. Another drawback with this type of truck is that pick-up and set-down utilizing forks involves back-and-forward movement of the entire truck—prime mover and boom alike—so as to slide the forks in and out of the pallet on which the load is positioned. This is a 'necessary evil' which, in itself imprecise, rough and ready, and jerky, becomes even more of a setback if the ground is uneven or unstable (invariably the case on a building site) and the danger arises of tipping-over altogether when handling a load at considerable height. Again, this particular truck is (almost without exception) incapable of picking-up and setting down from and onto excavated surfaces lying below the level of the ground on which its own drive-wheels happen to sit.

A third type of high lift truck still in widespread use utilizes a telescopic boom hinged at the bottom end to the truck chassis and designed to traverse back-and-forth bodily along tracks and relative mountings fitted to the chassis—also known as a 'boom-carriage'. This embodiment also incorporates a carrying-attachment hung out from the end of the boom topmost.

This third type of lift truck has the advantage of longer forward reach at medium and maximum height with respect to type 2, and an additional plus-factor is that no movement of the prime mover is required in order to slide forks in and out of the pallet when picking-up and setting down—this duly being accomplished by the boom carriage arrangement which travels back and forth whilst the truck remains at standstill.

This notwithstanding, the same drawbacks as arise with type 2 as regards horizontal penetration are also encountered here—i.e., when working at medium/maximum height, the boom will surely come up against obstacles projecting outward from the position aimed-at, when moving forward towards said position. A further drawback relating specifically to this type 3 truck is, that when moving the boom-carriage forward with boom, attachment and load consequently being displaced, the center of gravity itself is displaced forward—obliging the operator to lessen the single weights lifted if tipping-over is to be avoided. Furthermore, the boom-carriage design involves a more complex boom-mounting structure, such as renders the whole unit heavier and more costly. Finally, this type of truck is practically incapable of picking-up and setting-down at below ground-level, in the same way as type 2 as afore-described.

The object of the invention as described herein is that of overcoming all the drawbacks thus mentioned, improving and widening the scope of performance offered by this type of lift truck as a result.

In particular, the truck to which the invention relates offers a notable degree of penetration in the horizontal, reaching forward well beyond obstacles at medium and maximum working height, as well as at low level. This means, for instance, that a load can be set down comfortably on one of the upper floors of a building even though scaffolding may be erected, or some other such obstruction any how positioned, in such a way as to bring the obstacle to be cleared even further forward than would normally be the case. Better still, the high lift truck described herein can actually leapfrog such obstacles—that is to say, it can spot at points on a lower level than that presented by obstacles at medium and low working heights; for instance, setting-down or picking-up through a window-opening onto/from a floor lying below the level of the actual windowsill.

The lift truck described herein also possesses a considerable reach at medium to maximum working height, which is an indispensable operating characteristic when transferring loads from and to buildings where approach close-in is denied by low obstacles such as excavations or heaps of rubble, planted directly in the truck's path.

The truck as described herein is also capable of spotting on excavated surfaces lying six feet or more below the ground level negotiated by its own wheels.

Moreover, the truck to which the invention relates will slide its lifting-fork attachment in and out of a loading-pallet with both prime-mover and part of the boom at a complete standstill, rendering such manoeuvers swifter, sweeter, more precise, and free of any danger presented by the risk of tip-over.

As compared with truck type 3 aforedescribed, the truck to which the invention relates has increased lift-capacity, whilst affording a less complex, lighter and less costly type of construction in general terms; and all the advantages thus described are obtained without in any way sacrificing other performance features—viz, generous lift height, compact fold-down, ease-of-control, and low production costs.

SUMMARY OF THE INVENTION

All the advantages above, and others besides, are provided by the self-propelled high lift truck to which the invention relates. The truck comprises:

a first telescopic boom-assembly whose bottom end is hinged to a mounting at the truck-chassis, permitting of rotation about a horizontal axis;

means by which to rotate said first boom-assembly from lowered, all-but horizontal position, into raised position, and viceversa;

a second telescopic boom-assembly whose rear end is fixed immovably to the top end of said first telescopic boom-assembly such that their longitudinal axes create an unvarying angle instrumental in causing said second boom-assembly to lie practically horizontal whenever said first boom-assembly is in raised position; said second boom-assembly projecting forward along the longitudinal axis of the truck with the first boomassembly thus raised;

means for producing the extension of said second boom assembly; and a lifting-attachment fitted to the forward end of said second boom-assembly.

BRIEF DESCRIPTION OF THE DRAWINGS

Further features and advantages of the invention will emerge more clearly from the detailed description of a preferred embodiment which follows, offered as an unlimitative example and illustrated with the aid of the accompanying drawings, in which.

DESCRIPTION OF THE PREFERRED EMBODIMENT

Figure 1:
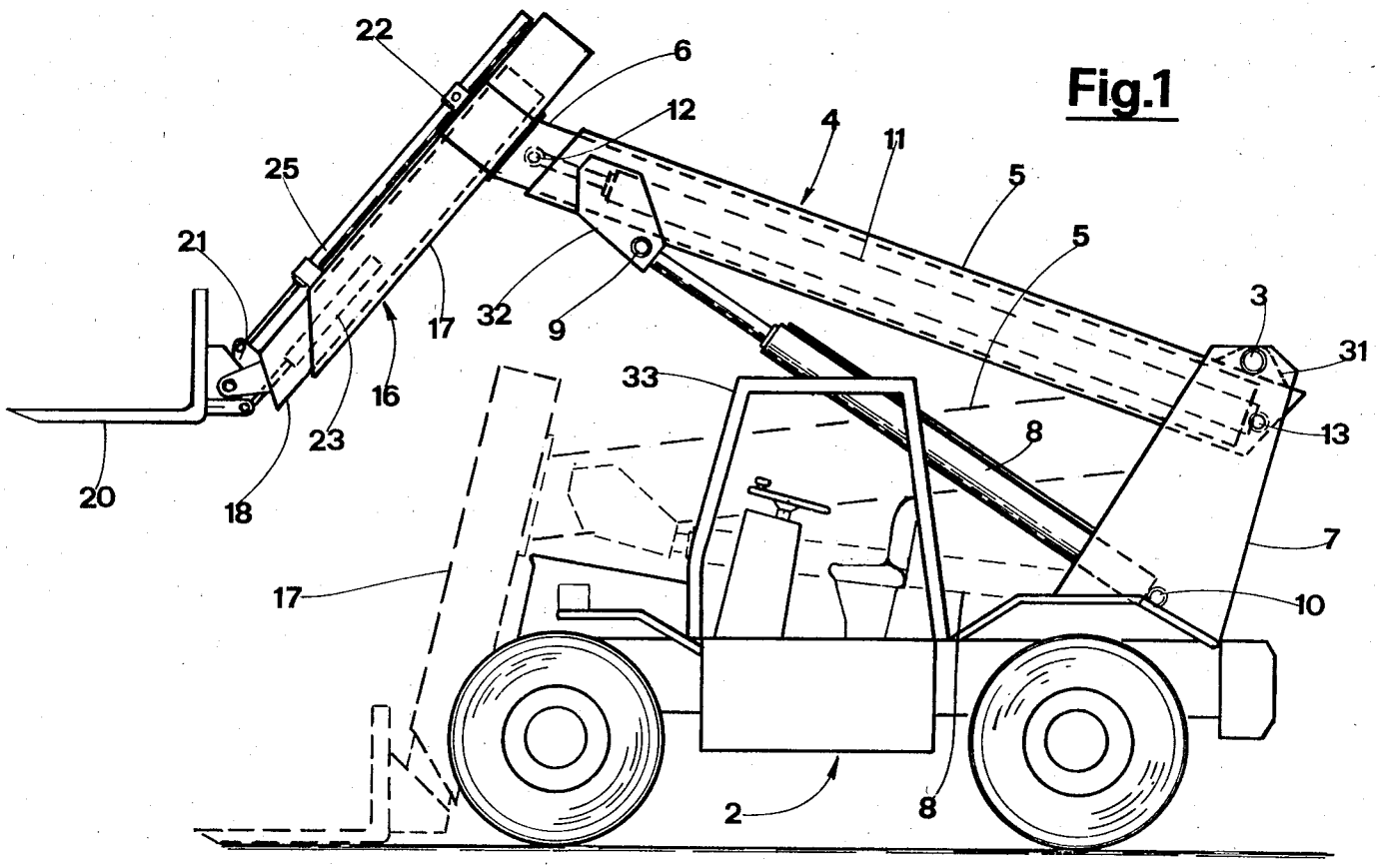
FIG. 1 shows the side view of the lift truck described herein, in vertical elevation.
Figure 2:
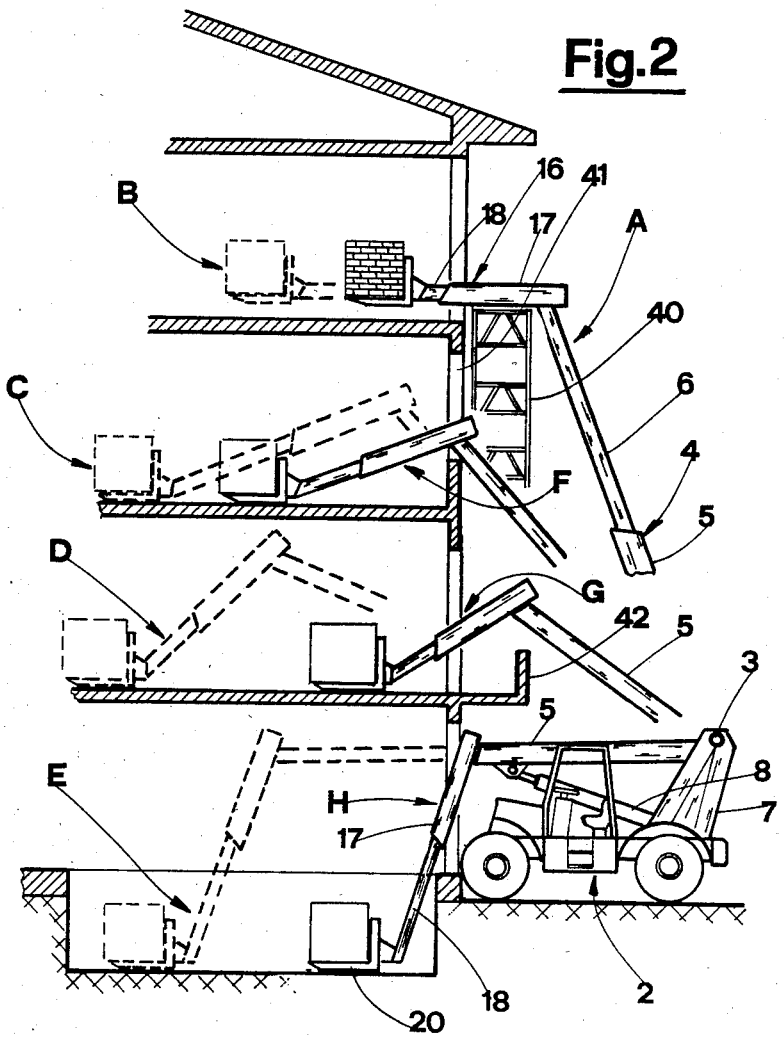
FIG. 2 shows a series of working configurations assumed by the lift truck.
Figure 3:
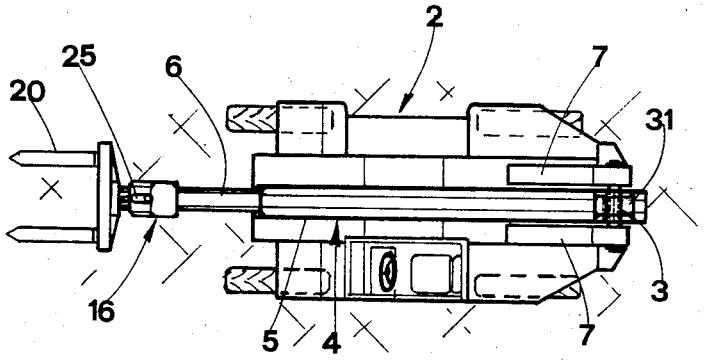
FIG. 3 is a plan of the lift truck from above, drawn in smaller scale than FIG. 1 but illustrating the same vehicle.

The lift truck illustrated in FIGS. 1 and 3 comprises a prime mover 2, to which the bottom end of a first extendible boom, or boom-assembly 4 is hinged via a horizontal pin 3, this disposed transversely with respect to the longitudinal axis of said prime mover 2. The two stages 5 and 6 of said boom 4 are of square section, basically speaking, and coaxial—one sliding within the other—the outer of the two 5 furnished at bottom with a pair of lugs 31 issuing from its outer surface and hinging with pin 3 aforesaid, the pin itself being located at a given distance above the truck chassis by way of appropriate means 7 consisting of a a pair of vertically-disposed plates fixed to the chassis itself above the vehicle's rear wheels and at either side of the bottom stage 5 of telescopic boom-assembly 4. A hydraulic actuator 8 positioned beneath boom-stage 5 has its bottom end hinged to a pin 10 lodged between the lower part of plates 7, and its top end similarly hinged by way of lugs 32 and pin 9 to the underside of said boom stage 5, and is designed to rotate the entire assembly 4 about pin 3 between lowered position—horizontal to all intents and purposes, and illustrated by the broken line in FIG. 1—and raised position, which is denoted A in FIG. 2, and creates a notably wide angle between boom and ground. Extend-and-retract of the boom itself 4 is provided by a hydraulic actuator 11 housed within stage 5 whose top end hinges with the top end of boom stage 6 via pin 12, and whose bottom end hinges likewise with the bottom end of stage 5 via pin 13.

Located at the top end of said boom-assembly 4, at the top end of stage 6 thereof, in fact, one has a second boom-assembly 16 which in the embodiment shown herein comprises two stages 17 and 18 (see FIG. 1) caused to slide coaxially one within the other. The rear end of the outer of said stages—stage 17—is fixed immovably to the top end of said boom stage 6 such that the longitudinal axes of respective boom assemblies 4 and 16 create an obtuse angle—say, of 110° which will cause boom 16 to lie horizontal once stage 5 of the first boom assembly 4 is raised fully into position A (see FIG. 2). It will be observed that boom-assembly 16 projects forward from stage 6 of the first boom along a path aligning with the longitudinal axis of prime mover 2.

Extend-and-retract of the second boom 16 thus described is brought about by further hydraulic actuator 25, this fixed at one end to stage 17 via lugs 22, and at the remaining, forward end, to stage 18 via lugs 21.

The same forward end of stage 18 carries a hinged loader-attachment, in this case a pallet-fork type, denoted 20. This same attachment 20 is caused to rotate with respect to boom stage 18 by a further hydraulic actuator housed within stage 18 itself and served by a fluid power circuit of conventional type utilized for such applications whose function is interlocked with that of the raise-and-lower circuit rotating boom stage 5 about its pin 3. The fork-actuator is denoted 23, and is designed to operate such that the forks of said attachment 20 will be displaced through the vertical maintained parallel both with their former position, and with the ground—regardless of the tilt produced by raising and lowering of said boom stage 5. Control of said actuator 23 can nonetheless be brought about independently of the interlock should it be wished to manoeuver the forks 20.

With stage 6 of the first boom retracted completely inside stage 5, and stage 18 of the second boom likewise retracted into stage 17, lowering stage 5 to the limit will cause the lift truck to assume its fully folded-down position (illustrated by the broken line in FIG. 1), this being the truck's most compact configuration possible.

In this state, boom stage 5 is all-but horizontal, lying no higher that the top of the cab 33, and projects forward no further than the front of the prime mover; stage 17 remains clear of the ground, and the main boom-actuator 8 is conveniently tucked-away under said boom stage 5. This fully-retracted state of the truck described herein corresponds broadly speaking to that of types 2 and 3 as described in the "background" preamble.

FIG. 2 illustrates the truck to which the invention relates carrying out either a pick-up or set-down manoeuver (the principle remains the same) with a load which could not be spotted with the prior art trucks described.

Full extension of both booms 4 and 16 produces considerable height and a good forward reach (position B); lowering the boom, reach is now increased (positions C, D and E), and the broken line drawings demonstrate maximum reach at the various heights illustrated (positions B, C, D and E), all of which lying through a circumferential arc centered on pin 3, practically speaking.

Positions A and B show the lift truck handling a load at maximum height and in doing so, riding over a facing obstacle—scaffolding for instance, denoted 40—so as to penetrate well into the building through an appreciable horizontal stretch to position B. Position F demonstrates how the boom-and-attachment will enter through a window 41 and spot a load on the floor at lower level that the windowsill. Position G illustrates the 'leapfrogging' capability, in this case to overcome a jutting balcony-and-railing 42, and finally, positions E and H show the the lift truck handling in a restricted area at below ground level.

It will be observed that in positions A and B (which represent the most common handling requirement for this type of appliance) the pallet-forks 20 will be slid-under or out-from-under the load simply by telescoping with boom stages 17 and 18 whilst the rest of the truck—i.e. prime mover 2 and boom 4, remains at standstill; the same applies whatever the working height when boom stage 5 is fully raised—that is, medium up to maximum lift height. In the same fashion, handling at low level or completely beneath ground level, stages 5 and 6 can be telescoped whilst the remainder of the truck keeps stationary.

Whatever the position, in fact, the pallet-forks may be slid-under or withdrawn-from-beneath the load simply operating the booms singly or in combination, keeping the truck chassis at standstill, permitting of swift, precise and smooth operation, free of upsets from vibration, and with no danger of the entire truck keeling-over off-balance.

Numerous modification of a practical nature may be made to constructive details of the invention thus described whilst in no sense straying from within bounds of protection afforded thereto by the claims appended. The telescopic booms, for instance, may incorporate more stages than the two described herein.

What is claimed:

1. Self-propelled high lift truck, comprising:

a first telescopic boom-assembly whose bottom end is hinged to mountings at the truck chassis, permitting a rotation about a horizontal axis;

means by which to rotate said first boom-assembly from a lowered, all-but horizontal position, into a fully-raised position, and vice versa;

a second telescopic boom-asssembly whose rear end is immovably fixed to the top end of said first telescopic boom-assembly such that the longitudinal axes of said assemblies create an unvarying angle instrumental in causing said second boom-assembly to lie practically horizontal when said first boom-assembly is in the fully-raised position aforesaid; said second boom-assembly projecting forward in alignment with the longitudinal axis of the truck's prime mover with said first boom-assembly in said fully-raised position;

means for telescoping said second boom-assembly;

a lifting attachment pivotally mounted to the forward end of said second boom-assembly; and means for rotating said lifting attachment relative to the second boom-assembly in such a way as to maintain a constant lie of the lifting attachment relative to the ground as the inclination of the second boom-assembly is caused to vary.

2. High lift truck as in claim 1, characterized in that the angle created between longitudinal axes of said first and second boom-assemblies (4 and 16) is 110° or thereabouts.

3. High lift truck as in claim 1 characterized in that said boom-assemblies (4 and 16) both comprise two or more telescopic stages caused to extend and retract by means of respective hydraulic actuators (11 and 25) housed/fitted and disposed with axis parallel to the relative axes of said boom-assemblies.

* * * * *